United States Patent [19]

Nelson

[11] Patent Number: 4,684,160

[45] Date of Patent: Aug. 4, 1987

[54] DOOR SECURITY DEVICE

[76] Inventor: Gordon J. Nelson, 1143 Sims, Apt. 3, Dickinson, N. Dak. 58601

[21] Appl. No.: 765,855

[22] Filed: Aug. 14, 1985

[51] Int. Cl.[4] ..... E05C 21/02

[52] U.S. Cl. ..... 292/340; 49/503; 29/526 R

[58] Field of Search ..... 292/1, 340, 346; 49/503, 462; 70/143; 29/526 R

[56] References Cited

U.S. PATENT DOCUMENTS

| | | | |
|---|---|---|---|
| Re. 31,276 | 6/1983 | Schlage | 292/340 |
| 1,091,453 | 3/1914 | Fletcher | 292/346 X |
| 1,919,739 | 7/1933 | Minzenmayer | 292/346 |
| 2,255,860 | 9/1941 | Riedel | 292/346 X |
| 3,279,840 | 10/1966 | Barone | 292/346 |
| 3,767,245 | 10/1973 | Keefe | 292/340 |
| 3,815,945 | 6/1974 | Lamphere | 292/340 |
| 3,918,207 | 11/1975 | Aliotta | 49/462 |
| 3,967,845 | 7/1976 | Governale | 292/340 |
| 4,005,890 | 2/1977 | Murch | 292/346 |
| 4,057,275 | 11/1977 | La Beaud | 292/340 |
| 4,074,484 | 2/1978 | Queren | 52/214 |
| 4,174,862 | 11/1979 | Shane | 292/346 |
| 4,186,954 | 2/1980 | Detlefs | 292/340 |
| 4,195,870 | 4/1980 | Percoco | 292/340 |
| 4,255,953 | 3/1981 | Dietrich et al. | 70/143 |
| 4,369,994 | 1/1983 | Vorves | 292/340 |
| 4,416,087 | 11/1983 | Ghatak | 49/462 |

*Primary Examiner*—Richard E. Moore

*Attorney, Agent, or Firm*—Merchant, Gould, Smith, Edell, Welter & Schmidt

[57] ABSTRACT

A door security device (1) consisting of a substantially trapezoidal plate (4) residing parallel to the plane of the door and an integrally formed lip (6) which is permanently affixed to door frame structural member (2). A door strike reinforcement tube (10) extends perpendicularly from plate (4) and is aligned with door lock striker (25) such that any force applied to the door (15) is resisted by the entire plate reinforcing device. A plurality of strike plate reinforcement extensions (10*a*) may also be used with multiple lock mechanisms.

3 Claims, 3 Drawing Figures

FIG. 1
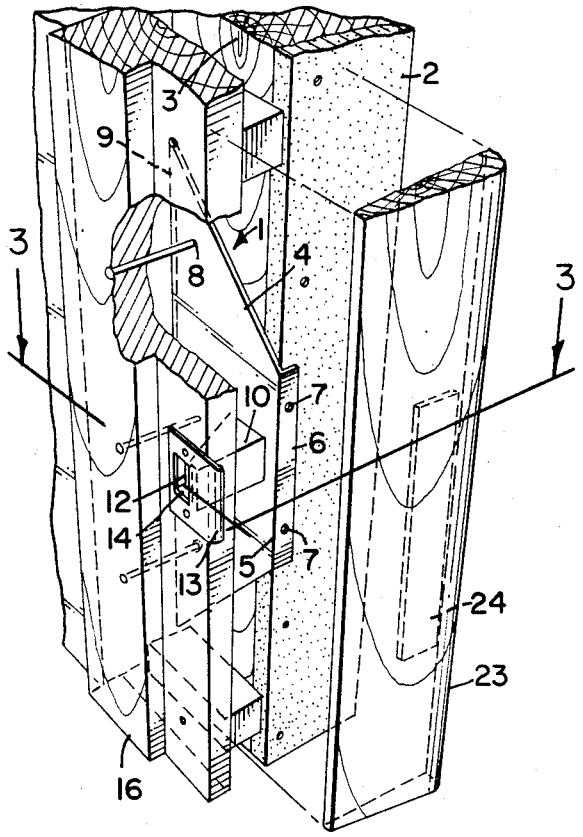
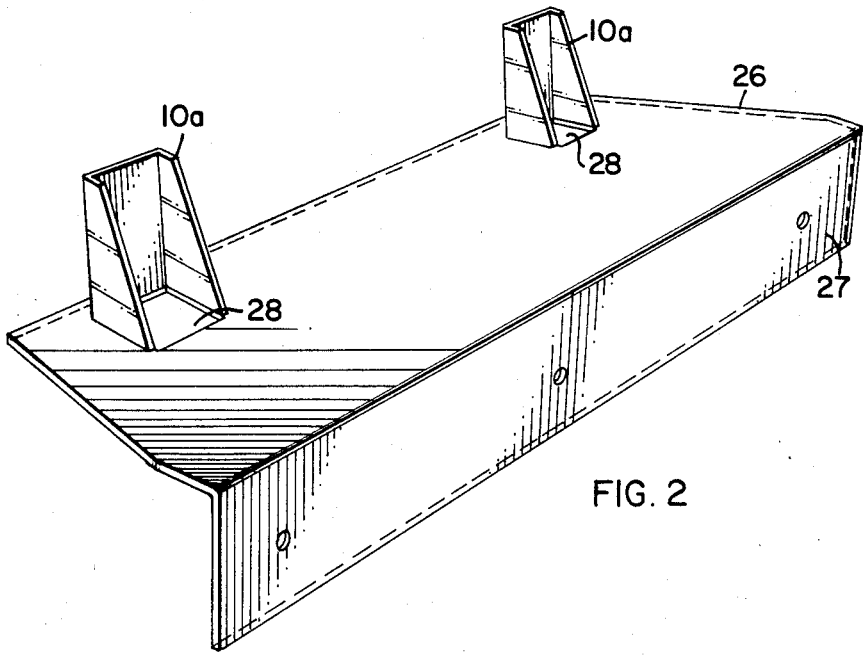
FIG. 2

DOOR SECURITY DEVICE

BACKGROUND OF THE INVENTION

1. Field of the Invention

This invention relates to devices used for the reinforcement of a door frame. The reinforcement disclosed in the present invention cooperates with a door latch strike plate to render the door frame resistant to being kicked or otherwise forcibly opened.

2. Description of Related Technology

Many configurations of door locks and bolt keeper strike plates have been proposed for providing sturdier and tighter fitting door arrangements. For example, U.S. Pat. No. 3,767,245, issued to Keefe, shows an arrangement in which a strike plate is enlarged and extended to lie between the door frame side rail and the door stop. The enlargement receives additional fastening screws. The door jamb is routed out to form a recess for receiving the strike and anchor plate with the striking surface of the keeper strike plate being flush with the surface of the door jamb. A door stop stripping is mounted on the door jamb over the elongated anchor plate. This device is not applicable to all doors because many door jambs are molded, and thus do not lend themselves to the routing operation required for mounting the plate. Also, the stripping, or trim, can be pried away leaving the anchoring screws exposed.

U.S. Pat. No. 3,815,945, issued to Lamphere, discloses a door frame security plate designed to prevent the door from being kicked in. The Lamphere device uses a specially milled side rail interlock with an enlarged, configured and extended strike plate perforated to receive more than the customary number of fastening screws. The screws are long enough to penetrate into the wood construction immediately abutting the door casing side rail. This apparatus, however, requires additional weakening of the jamb by milling out a seat for the security plate and, in addition, the plate extends in the general direction of any force that would be applied to break in. Therefore, it fails to provide a desirable reinforcement securing the frame against being split.

U.S. Pat. No. 3,918,207, issued to Aliotta, discloses a plate guard with a striker. The plate runs parallel to the opening on the striker plate and utilizes a lip member which rests at the frame edge. Thus, the Aliotta reference is in fact using an enlarge striker plate.

U.S. Pat. No. 3,967,845, issued to Gobernale, discloses a small metal reinforcing plate that is arranged beneath the usual striker plate in a routed recess of the wooden door jamb. The metal plate has small protrusions which extend into the jamb itself, but the primary resistence to forceful entry is still provided by wood screws that extend through both the original striker plate and the metal reinforcement plate. The Gobernale device reinforces the area immediately surrounding the striker plate, but does not address the larger problem of reinforcing the door jamb itself.

U.S. Pat No. 4,005,890, issued to Murch, provides a striker guard to be inserted along with the bolt receiver or striker plate. The guard itself is a flat metal bar which extends from the striker plate chamber into the door frame. This device when subjected to a kicking force permits the device to tip, that is the reinforcement member reflects, either because the metal making up the guard member bends, or the entire member itself rotates slightly within the door frame. In either case, the lock plunger is permitted to slip by the reinforcement guard member.

U.S. Pat. No. 4,057,275, issued to LaBeaud, discloses an elongated metal plate for fastening to the back of a wooden door jamb. In practice, this unit is suitable only for installation on a new door since it requirs removal of the entire side of the door jamb. Although the plate itself has substantial surface area, the portion of the plate which directly resists the force of the plunger consists of only a small lip formed at the edge of the reinforcement plate.

U.S. Pat. No. 4,074,484, issued to Queren, discloses a plate guard for the striker. In order to combat entry by means of kicking the door or using a crowbar at the point at which the locking means engages the door and the frame, the Queren device relies on a plate means to try and reinforce the door jamb itselt. The plate is inserted along the inside face of the frame at right angles to the striker plate. The holding screws used in the device are aligned in the same direction as the force which would be applied to the door during a forced entry. Thus, the holding screws would tend to be pulled out in a longitudinal direction, thus eliminating the possible use of nails as a fastener and relying entirely on the threads of a wood screw to provide resistance to the locked plunger.

U.S. Pat. No. 4,174,862, issued to Shane, discloses a U-shaped metal plate used for reinforcing a door frame. While this device provides great strength, it can only be installed during the initial construction phase because of its considerable size and interaction with the wall itself. The fixed dimensions of the device do not allow for any shimming or adjustment as would be required if the device would be retrofitted on an existing door. Finally, the shape of the device requires that the plunger extend a considerable distance into the reinforcing plate, thereby requiring the use of a deadbolt lock rather than a conventional door plunger.

U.S. Pat. No. 4,186,954, issued to Detlefs, discloses a lock strike plate assembly having a reinforcement rod that extends to the door frame and wall support. Due to the shape of the strike plate chamber, the strike plate itself is secured by wood screws only to the very edge of the door frame. The reinforcing rod, while extending a considerable distanced into the wall support, offers no resistance to twisting, but only to a shear force, and the shear force is resisted only by the rather small cross-sectional area where the reinforcing rod is welded to the strike plate chamber. In practice, the rod would tend to snap off under the force of a sudden blow and the remainder of the plate would easily deform under the twisting force which could be resisted only by the very small volume of wood gripped by the mounting screws.

U.S. Pat. No. 4,195,870, issued to Percoco, discloses a striker plate assembly secured to the door frame. A number of embodiments are shown. Each of the embodiments suffers from either being mounted too close to the edge of a door frame (FIG. 2), offering little resistance to shear force because the reinforcement mechanisms are only narrow rods (see rod 36 welded to plate 37 in FIG. 3) or the plate assembly is very difficult to install. Several of the embodiments include a great number of alignment holes and the use of abnormally long drills needed to accomplish installation. U.S. Pat. No. 4,211,442, issued to Hansen, discloses a strike plate for receiving a lock plunger. The Hansen device is mounted at the edge of the door frame studding with only a single screw, leaving a small volume of wood to resist any striking force. Because of the single screw mounting arrangement, this device may be easily tipped or rotated on impact.

U.S. Pat. No. 4,369,994, issued to Vorves, discloses a strike plate support utilizing rods extending into the door frame. The strength of this device is entirely dependent on the integrity of hinge pin 18. The use of rods as reinforcing members offers little resistance to rotating or slippage, being better suited for resisting only a pure shear force.

U.S. Pat. No. Re. 31,276, issued to Schlage, discloses a lock strike casing which fits into the door jam. The resistance to a shear force of this device is dependent solely on the strength of the wood screws holding the device into the door frame. When subjected to a striking or kicking force, the screws can be bent or pulled from the door jamb, or the door jam itself may be loosened directly, allowing the casing to twist and fall.

U.S. Pat. No. 4,416,087, issued to Ghatak, discloses a door frame reinforcing plate. Due to the fact that pilot holes must be drilled in order to install screws 28, the only part of this device which offers any resistance to a striking force are nuts 36. Thus, when subjected to a striking or kicking force this device tends to pull from the door frame since the bolts 28 offer no more resistance than nails except for the nuts placed on the ends. This device is also quite complicated to install because of the critical alignment required between the pilot holes, bolts, nuts and screws.

None of these prior art proposals solves the problem of preventing forced entry through a door by means of an easily retrofittable structural member. While some of the devices are quite strong, they entail major structural modifications. The other devices disclosed rely entirely on the door frame or the surface layer of the surrounding structure to provide resistance to forced entry. Although the devices themselves are quite strong in many cases, they merely act as a lever arm in removing the entire door jamb. The best solution to this problem is one which would derive strength from the wall of the structure surrounding the door yet which could be easily placed on an existing door without the need for structural modification, nor special fasteners with critical alignment of parts during installation.

SUMMARY OF THE INVENTION

The present invention addresses many of the problems identified in the prior art. The reinforcement device of the present invention is generally in the shape of a metal plate bent along its longitudinal dimension at a right angle. The plate is placed between the door frame and the wall subframe. This plate carries a generally rectangular tube or aperture whose open end is placed in alignment with the aperture of a conventional strike plate. When the bolt portion of the door latch assembly enters this tube or aperture, it is much more resistent to being forced open than would be the case if the strike plates were merely secured to the wood door frame by means of conventional reinforcement devices.

The present invention addresses the problem of resisting the two types of forces most commonly used by those attempting a forced entry through a door. First, and most common, is an attempt to break the door down directly by kicking the door or throwing the entire weight of a person against the door. In resisting such forces, a reinforcement device should have not only the ability to withstand the shear forces involved but also should eliminate any tendancy to rock or twist when confronted with such forces. If twisting or tipping is not adequately controlled in a door reinforcement device it may actually deform to the extent required to allow the door lock plunger to pass without the device or even the door frame having actually failed.

A second method of forcibly entering through a door is to use a crowbar or a portable hydraulic device which tends to spread the door from the frame allowing the plunger to pass by the strike plate. A door reinforcement device must therefore resist this longitudinal force which attempts to press the strike plate reinforcement device deeper into the wall. When the strike place reinforcement device is attached solely to the wooden door frame, the frame itself can deform even though the reinforcement device has not failed.

The present invention provides not only substantial resistance to the kicking or pushing force normally encountered but also provides substantial resistance to a longitudinal force which attempts to separate the door from the strike plate. The objects are achieved by mounting the reinforcement plate of the present invention to the wall frame structure itself thereby bypassing the door or door frame entirely. These objects are achieved in a device which is simple to install, does not require critical alignment steps, uses conventional fasteners and may be easily retrofitted to an existing door without the need for modification to either the door frame or the underlying wall structure.

BRIEF DESCRIPTION OF THE DRAWINGS

FIG. 1 shows an isometric view of a conventional door frame together with a preferred embodiment of the device of this invention in place.

FIG. 2 illustrates an isometric view of another embodiment of the present invention.

DETAILED DESCRIPTION OF THE INVENTION

Figure 3:
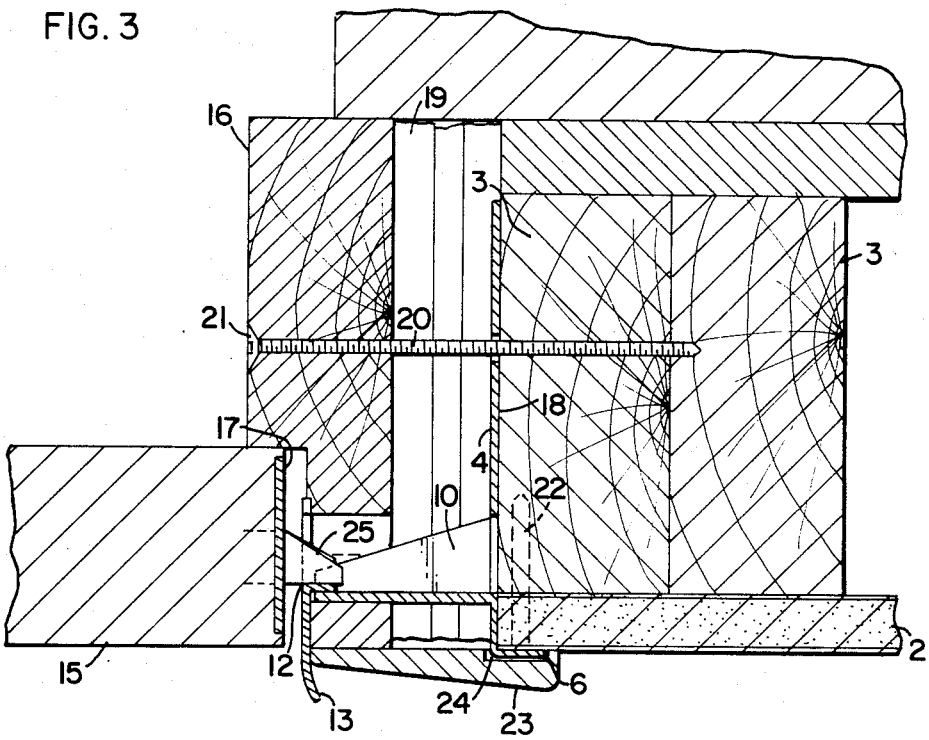
FIG. 3 shows a plan view in cross-section of the embodiment as illustrated in FIG. 1.

Referring now the to Drawings and more particularly to FIG. 1, the door security device is shown generally at 1. The device is shown in its installed position, being fastened to wall 2 and the surface of wall support member 3.

The preferred embodiment includes a metal plate 4 generally shaped as a trapezoid. The plate 4 is constructed of some suitable rigid material having a high yield strength. Mild steel of 16 gauge is suitable for most applications involving a wooden door frame constructed of 2×4 or 2×6 members. Since the metal plate is shaped generally as a trapezoid, two of the sides of the plate 4 will be parallel. The shorter side 5 is formed as a lip 6, the lip having a width of approximately $\frac{3}{4}''$. The lip 6 is at substantially a right angle to the plane occupied by the remainder of plate 4. Preferably, the lip 6 is formed by bending plate 4 along the short side 5, rather than attempting to attach by welding or other means a separate member to plate 4.

Lip 6 contains a plurality of mounting holes 7 which permit lip 6 to be mounted directly to the surface of wall 2. Preferably, the fasteners used should be continuously threaded wood screws, such as number 12-3, having a phillips head and inserted through orifices 7 such that the longitudinal axis of the screws forms an angle with lip 6 somewhat offset from 90°.

Plate 4 also contains mounting holes 8, three or four usually being the sufficient number, aligned along the longer side 9 of plate 4 and displaced from the edge of plate 4 a distance of approximately $\frac{3}{4}''$.

Attached to plate 4, is striker channel 10 which extends perpendicularly from the plane of plate 4 a distance of approximately $1\frac{1}{2}''$. Striker channel 10 is constructed of a rigid material having a high yield strength, typically of the same material as plate 4, and is fastened to plate 4 by means of a continuous weld around the base 11 of striker channel 10. The striker tube 10 has a wide base 11, tapering to a narrow tip 12. When installed, a conventional striker plate 13 is mounted on the door frame such that striker tube 10 extends toward the striker plate 13, the tip 12 of striker tube 10 extending into the orifice 14 of striker plate 13.

The mounting of the door security device and its operation can best be understood by examination of FIGS. 1 and 3. Typically, during the construction of a building the walls are built as a continuous structure. When a door is planned, the wall is constructed leaving a space where the door may be placed, typically with a margin of several inches surrounding the door in order to compensate for the size of the door frame and the door itself. Thus, as shown in FIGS. 1 and 3, the wall 2 and wall support member 3 are separated by considerable distance from door 15. In practice, a door frame 16 is placed in the space between the outer edge 17 of door 15 and the outer surface 18 of wall support member 3. Since the gap between surfaces 17 and 18 is variable, it is necessary to use shims 19 in order to make a tight fit between wall support member surface 18 and door frame 16. The presence of the shims, which are present in almost every door frame installation, is a contributing factor to the weakness and unsuitability of existing door jam reinforcement devices. Since most of these devices are attached to the door jamb, or frame, and rely on the door frame entirely for their foundational strength.

In the present invention, plate 4 is attached directly to wall support member 3 and therefore derives its strength from the wall member of the building structure itself. As can be seen in FIGS. 1 and 3, plate 4 is attached to surface 18 of wall support member 3 by a plurality of threaded fasteners 19. Ideally, threaded fasteners 19 are numbered 10-$5\frac{1}{2}$ 2" long straight shank wood shoes with counter sunk heads. The head 21 of threaded fasteners 20 should be recessed approximately $\frac{1}{2}$ inch into the door jam 16 with the area above the heads covered with putty or filled with a dowel. This will make the heads totally inaccesible in the final installation. The lip 6 is attached to wall 2 by means of threaded fasteners 22 the lip being covered by molding 23 in the final installation. A cavity 24 is routed within molding 23 such that molding 23 is able to fit snuggly against wall surface 2.

The only critical alignment which must be made during installation is to make sure that striker tube 10 is aligned with striker plate 13 so that lock plunger 25 will enter striker channel 10 when the door is closed. In order to ensure proper alignment and a snug fit between door 15, door frame 16 and striker channel 10, one may find it necessary to adjust the spacing of the door frame by means of removing or adding shims 19 in the space between plate 4 and door frame 16. Such shimming operations will not affect the strength of the present invention in the slightest since the plate 4 is mounted directly to wall support member 3 and derives none of its strength from the existence or placement of shims 19. Even if the frame 16 were to be substantially splintered or deformed during an attempt to forcibly open the door, there would be no effect on the position of striker channel 10 or its engagement with lock plunger 25.

As can be seen in FIG. 2, a second embodiment of the present invention comprises a plurality of striker tubes designated 10*a*. In this embodiment a plate 26 is substantially trapezoidal in shape and possesses a right angle bend forming lip 27. Plate 26 is mounted against wall support member 3 and lip 27 abuts wall surface 2 in the manner described for the other embodiment. In this embodiment, rectangular orifices 28 penetrate plate 26 at the base of striker channels 10*a* in order to allow the passage of an elongated lock plunger, such as a dead bolt which may pass through the plate and into an appropriate recessed area in wall support area 3, if necessary.

I claim:

1. A method of securing a door which resides along the same plane as the adjacent wall, comprising the steps of:

(a) affixing a plate to a wall support member adjacent to the door, the plate being formed as a trapezoid having a short parallel side, the plate having a lip formed integrally along the short parallel side;

(b) attaching the lip to the wall by means of threaded fasteners passing through mounting holes within the lip;

(c) affixing a striker channel to the plate, the striker channel being formed as a polyhedron, the polyhedron extending perpendicularly from the plate such that the striker channel is aligned with an existing strike plate which mates with an existing door lock plunger, the striker channel having a length sufficient to permit the strike plate to be interconnected with the plate, the plate being attached to a wall support member, the wall support member also serving as the foundation for the door jamb; and (d) closing the door such that an existing lock plunger passes through an existing strike plate in an existing door jamb, thereby engaging the striker channel.

2. A door security device comprising a plate affixed to a wall support member adjacent to a door which resides along the same plane as the wall, the plate being formed as a traperzoid having a short parallel side, the plate having a lip formed integrally along the short parallel side; the lip being attached to the wall by means of threaded fasteners passing through mounting holes within the lip; a striker channel affixed to the plate, the striker channel being formed as a polyhedron, the polyhedron extending perpendicularly from the plate such that the striker channel is aligned with a strike plate which mates with an existing door lock plunger, the striker channel having a length sufficient to permit the strike plate to be interconnected with the plate, the plate being attached to a wall support member, the wall support member also serving as the foundation door the door jamb; and wherein, when the door is closed, said lock plunger passes through said strike plate in said door jamb, thereby engaging the striker channel.

3. The door security device of claim 2, wherein the striker channel is mounted substantially perpendicular to the flat plate, the striker channel having a length of approximately $1\frac{1}{2}$ inches.

* * * * *